US010088101B2

(12) United States Patent
Griffith et al.

(10) Patent No.: US 10,088,101 B2
(45) Date of Patent: Oct. 2, 2018

(54) NATURAL GAS INTESTINE PACKED STORAGE TANK

(71) Applicant: Other Lab, LLC, San Francisco, CA (US)

(72) Inventors: Saul Griffith, San Francisco, CA (US); Tucker Gilman, San Francisco, CA (US); Peter S. Lynn, Oakland, CA (US); Kevin Simon, San Francisco, CA (US)

(73) Assignee: OTHER LAB, LLC, San Francisco, CA (US)

( * ) Notice: Subject to any disclaimer, the term of this patent is extended or adjusted under 35 U.S.C. 154(b) by 0 days.

(21) Appl. No.: 14/172,831

(22) Filed: Feb. 4, 2014

(65) Prior Publication Data

US 2014/0305951 A1 Oct. 16, 2014

Related U.S. Application Data

(60) Provisional application No. 61/766,394, filed on Feb. 19, 2013, provisional application No. 61/761,168, filed on Feb. 5, 2013.

(51) Int. Cl.
*A61G 3/00* (2006.01)
*F17C 1/00* (2006.01)

(52) U.S. Cl.
CPC ..... *F17C 1/00* (2013.01); *F17C 2201/0138* (2013.01); *F17C 2201/056* (2013.01);
(Continued)

(58) Field of Classification Search
CPC ..... F17C 2203/0663; F17C 2201/0138; F17C 2201/0109; F17C 2203/0619;
(Continued)

(56) References Cited

U.S. PATENT DOCUMENTS 2,380,372 A 7/1945 Alderfer
4,139,019 A 2/1979 Bresie et al.
(Continued)

FOREIGN PATENT DOCUMENTS

CA 2636100 A1 12/2009
CN 1036534 A 10/1989
(Continued)

OTHER PUBLICATIONS

International Search Report and Written Opinion dated Aug. 27, 2013, International Patent Application No. PCT/US2013/039565, filed May 3, 2013, 13 pages.
(Continued)

*Primary Examiner* — J. Gregory Pickett
*Assistant Examiner* — Elizabeth Volz
(74) *Attorney, Agent, or Firm* — Davis Wright Tremaine LLP

(57) ABSTRACT

A high-pressure pressure vessel for storing natural gas comprises a plurality of first vessel regions of first diameters, a plurality of couplers, and a fiber layer. A three dimensional volume is filled using at least in part the plurality of first vessel regions. Each coupler of the plurality of couplers couples each pair of first vessel regions of the plurality of first vessel regions. Each coupler of the plurality of couplers comprises a second vessel region of a second diameter and two third vessel regions that transition diameters between the first diameter and the second diameter. The three dimensional volume is filled using at least in part the plurality of couplers. The first vessel regions and the couplers comprise a material with low permeability to natural gas. The fiber layer surrounds the plurality of first vessel regions and the plurality of couplers.

19 Claims, 18 Drawing Sheets

(52) U.S. Cl.
CPC .. *F17C 2201/058* (2013.01); *F17C 2203/066* (2013.01); *F17C 2203/0619* (2013.01); *F17C 2203/0663* (2013.01); *F17C 2205/0111* (2013.01); *F17C 2205/0332* (2013.01); *F17C 2209/2154* (2013.01); *F17C 2209/222* (2013.01); *F17C 2221/033* (2013.01); *F17C 2223/0123* (2013.01); *F17C 2223/036* (2013.01); *F17C 2260/017* (2013.01); *F17C 2260/018* (2013.01); *F17C 2270/0178* (2013.01)

(58) Field of Classification Search
CPC ..... F17C 2203/066; F17C 2201/056; F17C 2201/058; F17C 1/04; F17C 2205/0111; F17C 2205/0332; F17C 2209/2154; F17C 2209/222; F17C 2221/033; F17C 2223/0123; F17C 2223/036; F17C 2260/017; F17C 2260/018; F17C 2270/0178; F02M 21/00; F02M 21/02
USPC ..... 220/581, 586, 501, 564; 280/834
See application file for complete search history.

(56) References Cited

U.S. PATENT DOCUMENTS

| | | | | |
|---|---|---|---|---|
| 4,253,454 | A | 3/1981 | Warncke | |
| 4,932,403 | A | 6/1990 | Scholley | |
| 5,036,845 | A | 8/1991 | Scholley | |
| 5,653,358 | A | 8/1997 | Sneddon | |
| 5,839,383 | A * | 11/1998 | Stenning | B63B 25/14 114/72 |
| 6,116,464 | A | 9/2000 | Sanders | |
| 6,293,590 | B1 | 9/2001 | Ogasa | |
| 6,527,075 | B1 * | 3/2003 | Izuchukwu | F17C 1/02 180/69.5 |
| 6,579,401 | B1 | 6/2003 | Izuchukwu et al. | |
| 9,217,538 | B2 | 12/2015 | Griffith et al. | |
| 2004/0145091 | A1 * | 7/2004 | Willig | F16L 9/121 264/510 |
| 2004/0216656 | A1 | 11/2004 | Fitzpatrick et al. | |
| 2005/0205137 | A1 | 9/2005 | Pouchkarev | |
| 2008/0098562 | A1 | 5/2008 | Tagliaferri et al. | |
| 2009/0308475 | A1 * | 12/2009 | Stringfellow | B29C 63/343 138/98 |
| 2011/0041518 | A1 | 2/2011 | Peterson et al. | |
| 2014/0305951 | A1 | 10/2014 | Griffith et al. | |
| 2015/0048095 | A1 | 2/2015 | Sanders | |
| 2016/0018057 | A1 | 1/2016 | Griffith et al. | |
| 2016/0363265 | A1 | 12/2016 | Griffith et al. | |

FOREIGN PATENT DOCUMENTS

| | | | |
|---|---|---|---|
| CN | 1231639 | A | 10/1999 |
| CN | 2416338 | Y | 1/2001 |
| CN | 1518511 | A | 8/2004 |
| EP | 2404872 | A1 | 1/2012 |
| EP | 3141793 | A1 | 3/2017 |
| RU | 42863 | U1 | 12/2004 |
| RU | 81568 | U1 | 3/2009 |
| RU | 2426024 | C2 | 8/2011 |
| RU | 141427 | U1 | 6/2014 |
| WO | 9814362 | A1 | 4/1998 |
| WO | 200195967 | A1 | 12/2001 |
| WO | 2001095966 | A1 | 12/2001 |
| WO | 0239010 | A2 | 5/2002 |
| WO | 2008081401 | A1 | 7/2008 |
| WO | 2010107317 | A1 | 9/2010 |
| WO | 2013056785 | A2 | 4/2013 |
| WO | 2013166452 | A1 | 11/2013 |
| WO | 2014123928 | A1 | 8/2014 |

OTHER PUBLICATIONS

International Search Report and Written Opinion dated Mar. 16, 2017, International Patent Application No. PCT/US2016/064796, filed Dec. 2, 2016, six pages.
International Search Report and Written Opinion dated Mar. 23, 2017, International Patent Application No. PCT/US2016/037633, eight pages.
International Search Report and Written Opinion dated May 14, 2014, International Patent Application No. PCT/US2014/014729, filed Feb. 4, 2014, 11 pages.
International Search Report and Written Opinion dated Feb. 21, 2018, International Patent Application No. PCT/US2017/058068, filed Oct. 24, 2017, 8 pages.
International Search Report and Written Opinion dated Jun. 21, 2018, International Patent Application No. PCT/US2018/025280, filed Mar. 29, 2018, 7 pages.
International Search Report and Written Opinion dated Jun. 28, 2018, International Patent Application No. PCT/US2018/025283, filed Mar. 29, 2018, 8 pages.

* cited by examiner

NATURAL GAS INTESTINE PACKED STORAGE TANK

CROSS REFERENCE TO OTHER APPLICATIONS

This application claims priority to U.S. Provisional Patent Application No. 61/761,168 entitled NATURAL GAS INTESTINE PACKED STORAGE TANK filed Feb. 5, 2013 which is incorporated herein by reference for all purposes.

This application claims priority to U.S. Provisional Patent Application No. 61/766,394 entitled NATURAL GAS INTESTINE PACKED STORAGE TANK filed Feb. 19, 2013 which is incorporated herein by reference for all purposes.

STATEMENT REGARDING FEDERALLY-SPONSORED RESEARCH

This invention was made with Government support under DE-AR0000255 awarded by the US DOE. The Government has certain rights in this invention.

BACKGROUND OF THE INVENTION

Natural gas is typically stored at high pressure in large cylindrically shaped tanks. If space for storing the natural gas is constrained—for example, on a natural gas powered vehicle—the cylindrical shape limits the total gas storage capability.

BRIEF DESCRIPTION OF THE DRAWINGS

Various embodiments of the invention are disclosed in the following detailed description and the accompanying drawings.

DETAILED DESCRIPTION

Figure 1A:
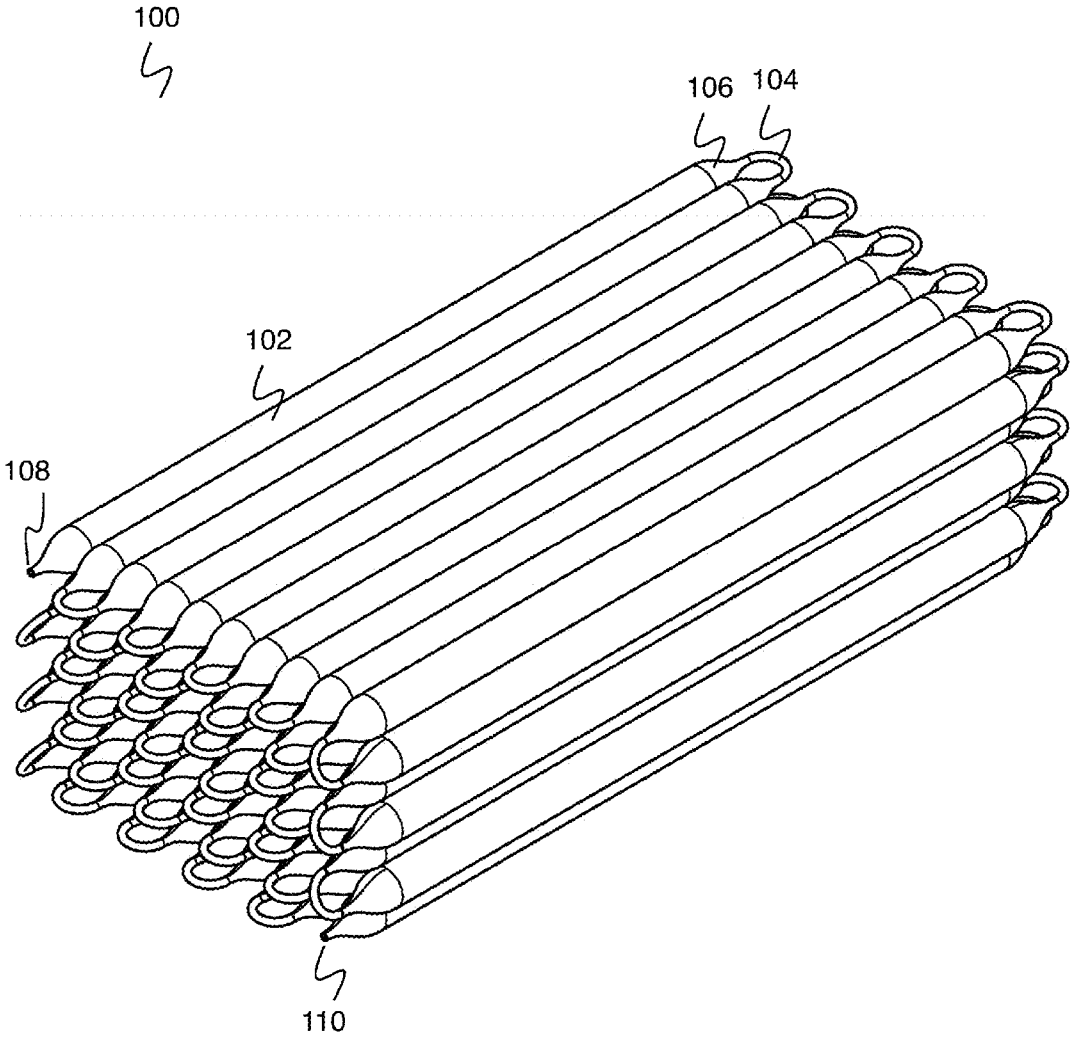
FIG. 1A is a diagram illustrating an embodiment of an intestine packed natural gas storage tank.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A high-pressure pressure vessel for storing natural gas comprises a plurality of first vessel regions of first diameters, wherein the first vessel regions are of one or more lengths in order to fill a three dimensional volume; and a plurality of couplers, wherein each coupler of the plurality of couplers couples each pair of first vessel regions of the plurality of first vessel regions, wherein the coupler comprises a second vessel region of a second diameter and two third vessel regions that transition diameters between the first diameter and the second diameter, wherein the second vessel regions are of one or more lengths in order to fill the three dimensional volume; and wherein the first vessel regions and the couplers comprise a material with low permeability to natural gas. The high-pressure pressure vessel additionally comprises a fiber layer, wherein the fiber layer surrounds the plurality of first vessel regions and the plurality of couplers.

In some embodiments, an intestine packed natural gas storage tank stores natural gas at high pressure. It is able to fill an irregularly shaped volume at high density. The intestine packed natural gas storage tank comprises storage regions comprising tubes of a first diameter. The storage regions are densely packed in cross-section (e.g., using a hexagonal dense packing) and have lengths chosen to fill a desired volume. The storage regions are connected by connectors comprising a bending region of a second diameter and two transition regions for transitioning from the first diameter to the second diameter. The storage regions and couplers are formed from a material with low permeability to natural gas.

Typical natural gas storage tanks are large cylinders. However, the cylinders are bulky and do not easily fit into 3-dimensional spaces efficiently—especially, for irregular spaces. In 1890, Giuseppe Peano discovered a class of curves that fill 2-dimensional space, a result which Hilbert extended to 3-dimensional cubes. It can be shown that such a curve can densely fill any 2- or 3-dimensional shape. Based on these insights, a compressed gas storage tank modeled after the human intestine is disclosed. The human intestine is an example of a high density curve that efficiently fills an irregular volume. It should be noted that in the design of a cylindrical tank the ratio of the tank mass to the contained gas mass is not dependent on tank geometry. The mass of the material used, and thus the bulk material cost is constant for a given pressure and material yield stress. With no penalty paid (in material cost or packing density) for moving to small diameter tubes, the ability to fit the tank in to any 3 dimensional shape desired is gained—for example, the embedding of a tank into the chassis of a vehicle.

In some embodiments, the manufacture of the natural gas storage tank is such that after the storage regions and couplers are connected together to form a long tube, a fiber layer is formed surrounding the tube. The tank storage regions are made as straight sections so that the regions can be over braided by running the regions through a braiding machine. The fiber layer provides strength to hold the natural gas pressure and prevent the tube from deforming. An abrasion prevention layer is then applied to prevent the fiber layer from being damaged. In some embodiments, one or more fittings are attached to the tube for allowing gas to move in or out of the tank. The tank is then folded into the finished shape and placed in a mounting box.

FIG. 1A is a diagram illustrating an embodiment of an intestine packed natural gas storage tank. In the example shown, natural gas storage tank 100 comprises a folded tube designed to fit within a predetermined three-dimensional space for the purpose of storing natural gas. In some embodiments, natural gas storage tank comprises a storage tank for a natural gas powered vehicle, and is designed to fit within a vehicle cavity (e.g., the cavity previously intended for the gasoline tank, the cavity previously intended for the spare tire, the trunk, a pickup truck bed, etc.). In some embodiments, natural gas storage tank 100 additionally comprises a mounting box surrounding the storage tank for holding the storage tank in the desired shape and mounting the storage tank in the desired location (e.g., in the vehicle cavity). Natural gas storage tank 100 comprises a plurality of first regions (e.g., storage regions 102), and a plurality of couplers (e.g., each coupler comprises one bending region 104 and two transition regions 106). Bending regions 104 bend to connect the ends of two storage regions 102 running in parallel. In some embodiments, the radius of the bend in each bending region 104 is approximately equal to the tube radius of storage regions 102. The tube radius of bending region 104 is chosen to be appropriately small to bend at the necessary bend radius. In some embodiments, the radius of bending regions 104 is smaller than the tube radius of storage regions 102. In some embodiments, the ratio of the tube radius of storage regions 102 to the tube radius of bending regions 104 is in the range of 1-8 depending on the material of the bend regions. In some embodiments, bend regions are composed of multiple materials to allow bending at larger ratios. Each transition region comprises a transition region for transitioning from a tube of the tube radius of storage regions 102 to a tube of the tube radius of bending regions 104. In some embodiments, storage regions 102 are of one or more lengths in order to fill a three dimensional volume. In some embodiments, storage regions 102 are of a plurality of lengths in order to fill a non-rectangular volume. In some embodiments, bending regions 104 are of one or more lengths in order to fill a three dimensional volume. In some embodiments, bending regions 104 are of a plurality of lengths in order to fill a non-rectangular volume. Storage regions 102 are oriented substantially parallel to one another. In some embodiments, storage regions 102 are arranged in a cross-sectional dense packing (e.g., a cross-section of natural gas storage tank 100 through storage regions 102 shows that storage regions 102 are densely packed). In various embodiments, storage regions 102 are arranged in a hexagonal packing, a rectangular packing, one of the 9 compact circle packing with two sizes (e.g. c4), or any other appropriate packing. In the example shown, bending regions 104 connect to a transition region 106, bend 180 degrees, and connect to a second transition region. In some embodiments, bending regions 104 connect to a transition region 106, bend 180 degrees, extend through the length of natural gas storage tank 100 (e.g., in parallel with storage regions 104), bend 180 degrees a second time, and connect to a second transition region. These embodiments utilize one of the 9 compact packing with two sizes. In some embodiments, bending regions 104 extend through the length of natural gas storage tank 100 in order to provide the second tube radius necessary for a c4 packing or other compact circle packing with two sizes.

In some embodiments, natural gas storage tank 100 additionally comprises port 108. In some embodiments, port 108 includes a fitting (e.g., a fitting for connecting an external hose, pipe, tank, etc.). In various embodiments, port 108 comprises a port for filling the tank from a natural gas supply, a port for releasing natural gas from the tank for use, a port for venting the tank (e.g., emptying the tank to atmosphere in case of emergency), a port for multiple uses, or a port for any other appropriate use or uses. In some embodiments, the end of natural gas storage tank 100 opposing port 108 (e.g., end 110) comprises a port. In some embodiments, end 110 comprises a stopper (e.g., end 110 is closed to gas flow). In the example shown, port 108 and end 110 are configured at the corners of the volume of natural gas storage tank 100. In some embodiments, one or both of port 108 and end 110 are configured at a desired location away from the corners of the volume of natural gas storage tank 100 (e.g., to place one or more ports at desired locations on the surface of the volume of natural gas storage tank 100). For example, when the folded tank is placed inside a box and the box is placed in the same location as a gas tank of a vehicle, the location of the port is in the same location as the original port for the gas tank. The snaking of the storage tube then needs to start from the input/output port and be snaked from the input/output port to fill the volume of the box. In some embodiments, natural gas storage tank 100 additionally comprises a port not located at an end of the tank (e.g., located within one of storage regions 102, transition regions 106, or bending regions 104).

In some embodiments, natural gas storage tank 100 comprises a tank fabricated from a flexible polymer (e.g., ethylene vinyl alcohol (EVOH), high density polyethylene (HDPE), ethylene-vinyl acetate copolymer (EVAL™), Polytetrafluoroethylene (PTFE), etc.). The flexible plastic comprises a material with low permeability to natural gas (e.g., a material that meets standards for natural gas storage). Natural gas storage tank 100 comprises a fiber layer surrounding the flexible plastic layer. The fiber layer increases the burst pressure (e.g., provides physical strength to prevent the flexible plastic layer from expanding or bursting as natural gas pressure is added). In various embodiments, the fiber layer is whipped, wound, braided, woven, or taped. In various embodiments, the fiber layer comprises glass fibers, plastic fibers, metal fibers, carbon fibers, or any other appropriate fibers. In some embodiments, natural gas storage tank 100 comprises an abrasion prevention layer (e.g., a layer to protect the fiber layer from damage). In various embodiments, the abrasion prevention layer comprises a spray on abrasion prevention layer, a taped abrasion prevention layer, a mold on abrasion prevention layer, a thermo polymer, or any other appropriate abrasion prevention layer.

Figure 1B:
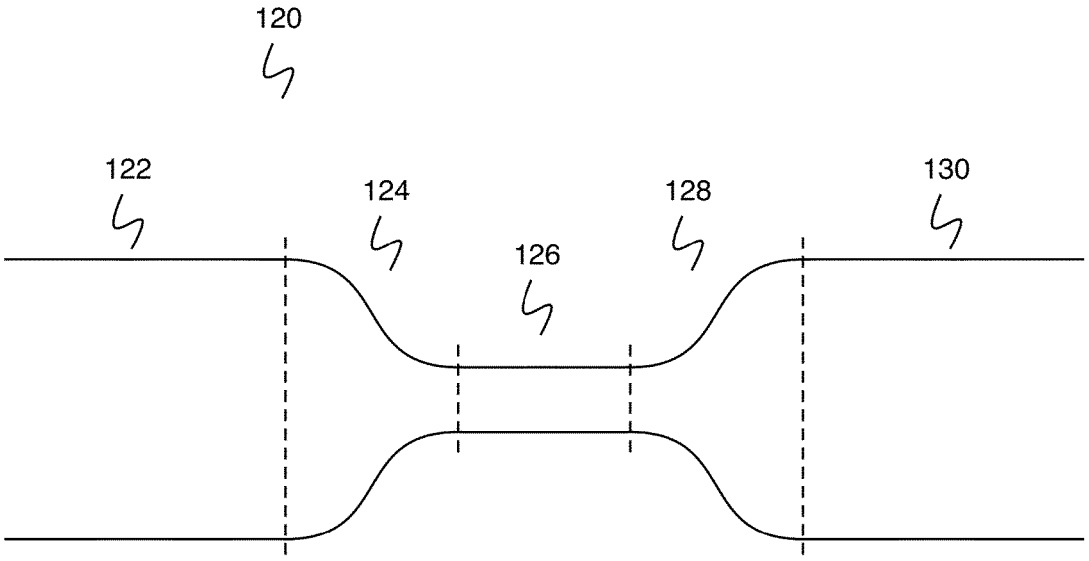
FIG. 1B is a diagram illustrating an embodiment of a natural gas storage tank.

FIG. 1B is a diagram illustrating an embodiment of a natural gas storage tank. In the example shown, natural gas storage tank 120 comprises a lengthwise cross section of a natural gas storage tank (e.g., natural gas storage tank 100 of FIG. 1A). Natural gas storage tank 120 comprises storage region 122, transition region 124, bending region 126, transition region 128, and storage region 130. Bending region 126 is not bent. In some embodiments, bending region 126 is formed straight (e.g., as shown) and bent after forming (e.g., bent by hand or by a machine). In some embodiments, transition region 124, bending region 126, and transition region 128 comprise a coupler. In some embodiments, the storage regions and the couplers are formed or cut separately and then bonded together (e.g., welded). In some embodiments, the couplers have a plurality of lengths (e.g., region 126 has a variety or plurality of lengths to accommodate the geometry of the box or to achieve the dense packing in cross-section—2 diameter dense packing).

In some embodiments, transition region 124 has a targeted geometry that is designed to allow for continuous braiding at an optimized braid angle, this in turn achieves minimal weight of the transition region and enables maximum overall tank energy density. In particular, the taper geometry that is targeted is described as well as a varying braid over the variable radius shapes such that the braid fibers stay in force equilibrium. For the storage tank, the variable radius cylinder starts out with a large radius $r_0$ and shrinks to a small radius $r_1<r_0$. The mean curvatures at the ends are $1/r_0$ and $1/r_1$. When the radius starts to shrink, the curvature in the axial direction changes from zero to positive, increasing the mean curvature. Since the amount of bending force is roughly proportional to mean curvature, higher mean curvature means that a higher pressure can be resisted. Unfortunately, eventually the taper must become concave in the axial direction in order to meet up with the smaller cylinder, causing a decrease in the mean curvature which must be countered by a smaller radius. This raises the question of the fastest possible taper that stays within a given mean curvature bound. Let z be the distance along the axial direction, r=r(z) the variable radius and define:

$$E=1+r_z^2.$$

The mean curvature is given by:

$$H=\frac{1}{2r\sqrt{E}}-\frac{r_{zz}}{2E^{3/2}}$$

The mean curvature of the large cylinder is $\frac{1}{2}r_0$, so the space of curves satisfying $H\geq\frac{1}{2}r_0$ needs to be understood. Extremal curves where the equality holds are therefore solutions to:

$$H=\frac{1}{2r_0}$$

$$\frac{1}{2r\sqrt{E}}-\frac{r_{zz}}{2E^{3/2}}=\frac{1}{2r_0}$$

$$r_0E-r_{zz}rr_0=rE^{3/2}$$

$$r_{zz}rr_0+rE^{3/2}-r_0E=0.$$

which can be solved numerically.

Figure 1C:
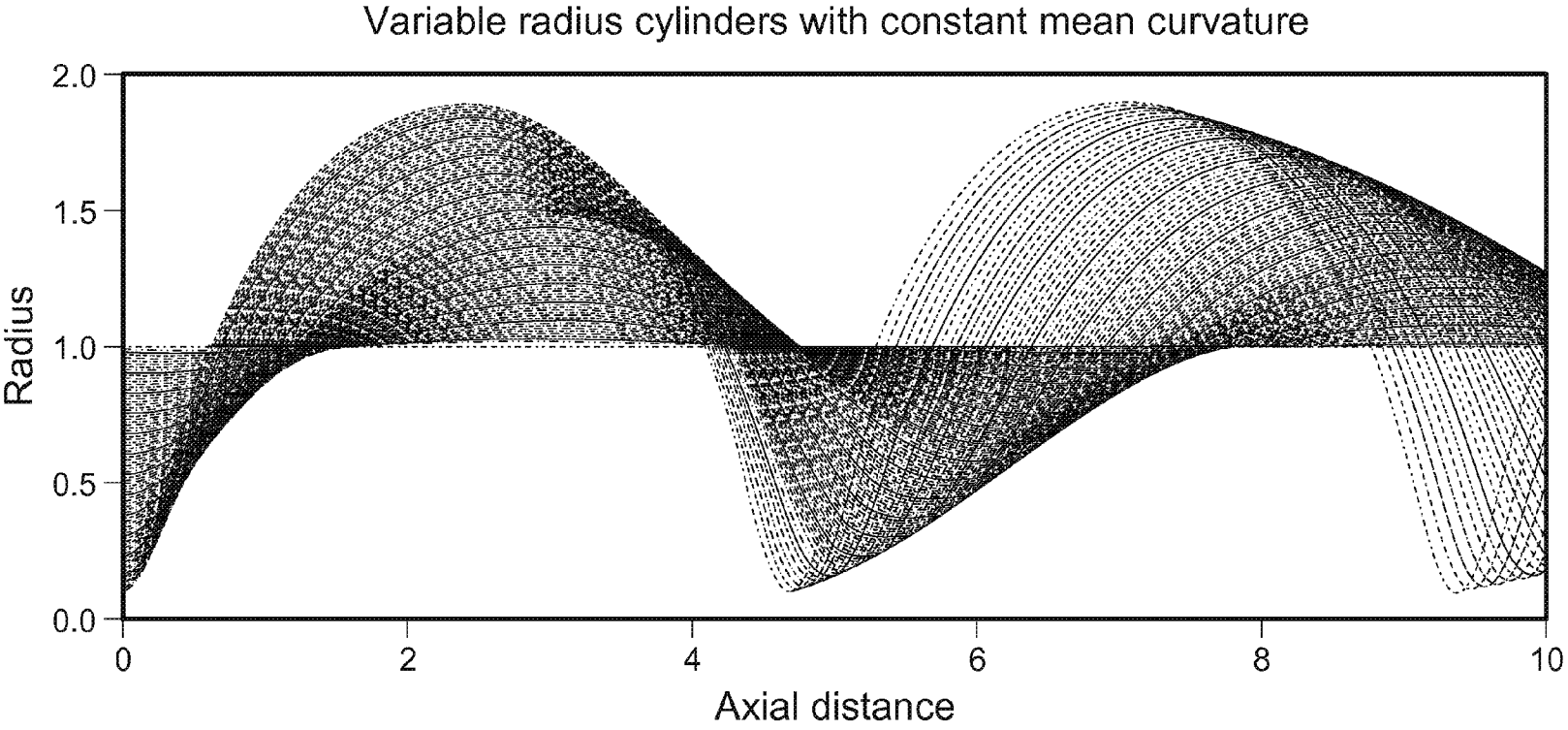
FIG. 1C is a diagram illustrating various variable radius cylinders with constant mean curvatures.

FIG. 1C is a diagram illustrating various variable radius cylinders with constant mean curvatures. In the example shown, when $r_0=1$ for normalization, solutions are shown starting with $r_z=0$ and different initial radii. Note that the curve remains axially concave up to radius 1, and therefore some freedom is involved in choosing how to complete the taper near the large cylinder.

Figure 1D:
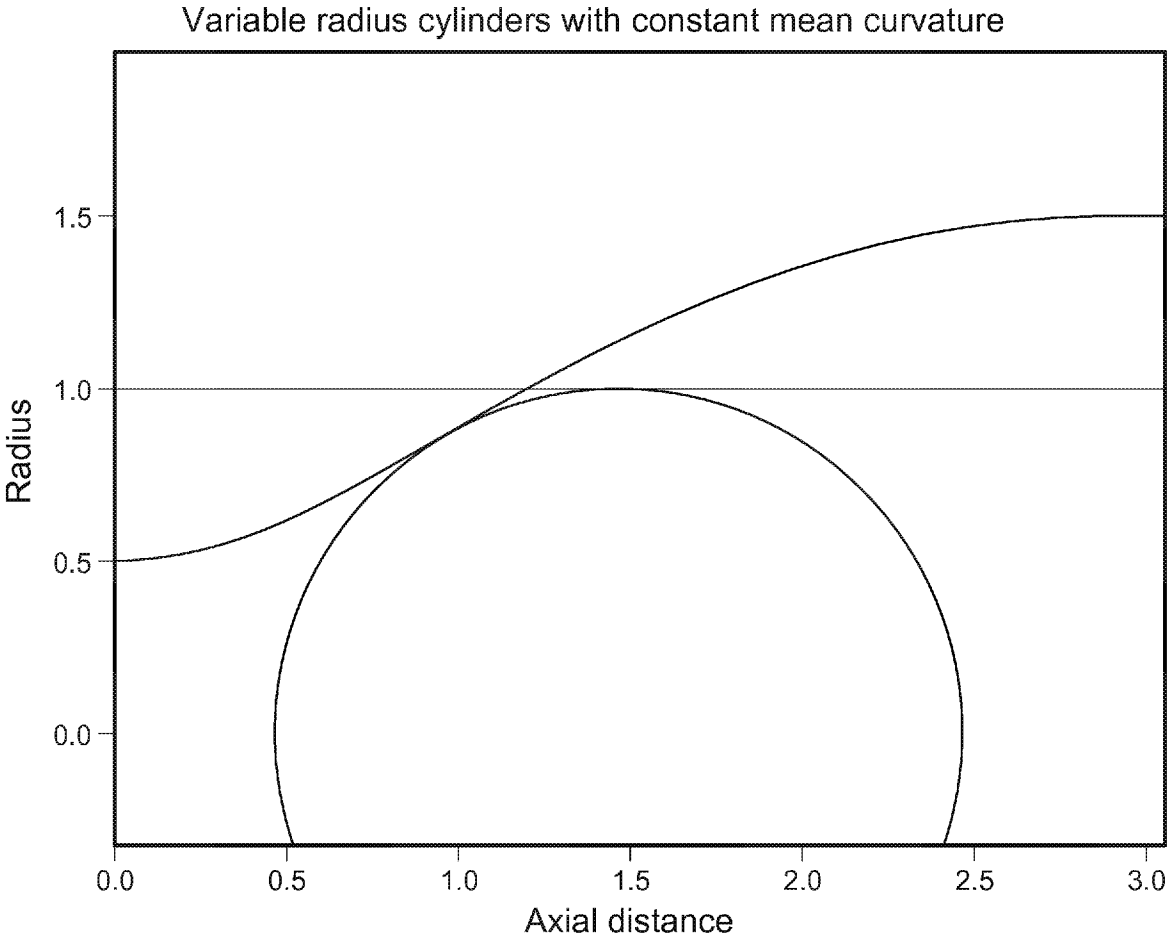
FIG. 1D is a diagram illustrating switching from a constant mean curvature cylinder to a spherical cap to join two cylinders of different radii.

FIG. 1D is a diagram illustrating switching from a constant mean curvature cylinder to a spherical cap to join two cylinders of different radii. In the example shown, a switch from a constant mean curvature cylinder to a spherical cap to join two cylinders of different radii. Another is to use single constant mean curvature curve with mean curvature larger than ½r0, chosen such that the ratio between the minimum and maximum radii is r0/r1. There are likely further options, so a further criterion is needed to pick out the best one. In some embodiments, there is a tradeoff between the optimal braid angle change (e.g., how far from a cylinder the force optimized angle becomes) and the density loss from making the transition regions too long. In some embodiments, 2 inches for the transition region, which corresponds to constraining the braid angle to +/−5 degrees and it is not prohibitively long. In various embodiments, optimal braid angle comprises a braid angle that is one or more of the following: optimally strong, optimally cheap, optimally strong with optimal weight, or any other appropriate optimality or combination of optimalities.

Figure 2A:
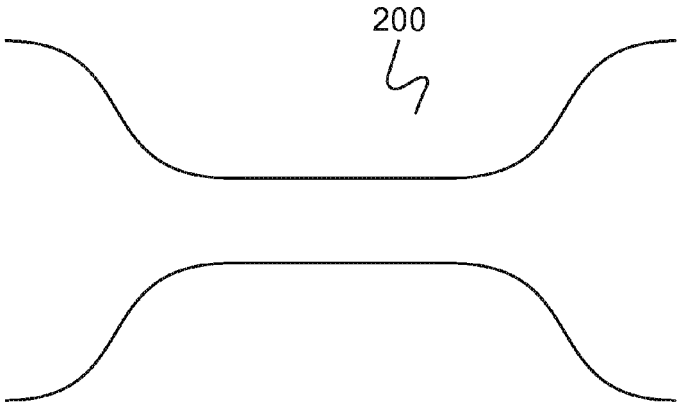
FIGS. 2A and 2B are diagrams illustrating embodiments of a coupler and a storage region.
Figure 2B:
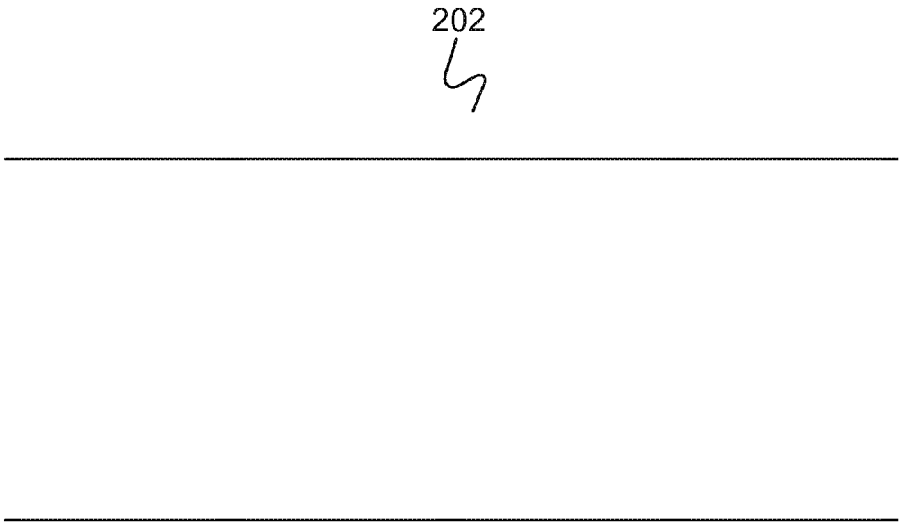

FIGS. 2A and 2B are diagrams illustrating embodiments of a coupler and a storage region. In the examples shown, coupler 200 comprises a coupler (e.g., a coupler as shown in FIG. 1A). In some embodiments, coupler 200 is formed from plastic. In various embodiments, coupler 200 is formed by injection molding, injection molding with inserts of extruded tube, extrusion blow molding, continuous extrusion blow molding, rotary wheel blow molding, variable diameter extrusion, extrusion with compression forming, or spin forming, or any other appropriate forming process. Storage region 202 comprises a storage region (e.g., a storage region as in storage region 122 or storage region 130 of FIG. 1A). In various embodiments, storage region 202 is formed by injection molding, blow molding, extrusion, or any other appropriate process.

Figure 3A:
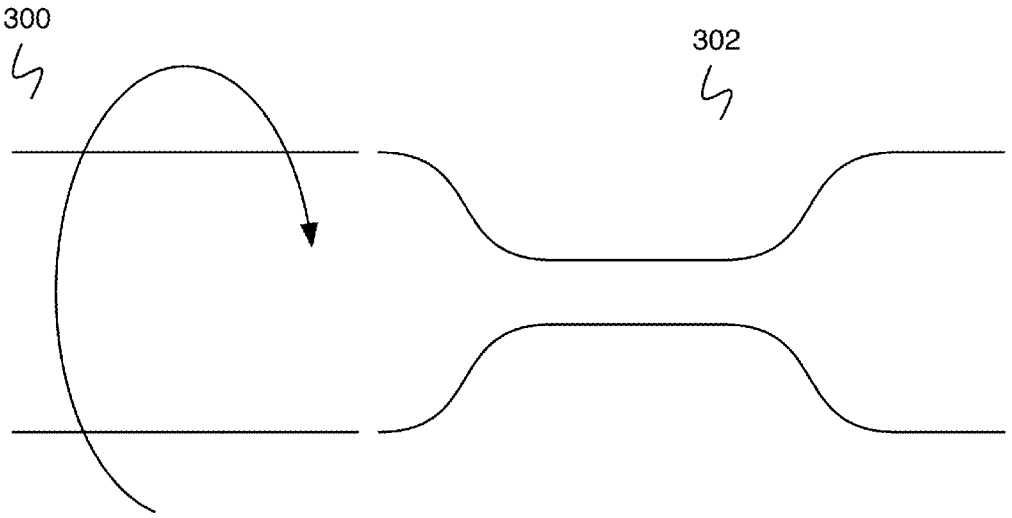
FIG. 3A is a diagram illustrating an embodiment of a joining process.

FIG. 3A is a diagram illustrating an embodiment of a joining process. In some embodiments, the joining process shown in FIG. 3A is used to form a natural gas storage tank (e.g., natural gas storage tank 120 of FIG. 1B). In the example shown, storage region 300 is to be joined to partial natural gas storage tank 302. Partial natural gas storage tank 302 comprises an alternating chain of storage regions and couplers, terminating with a coupler positioned adjacent to storage region 300. Storage region 300 is spun and forced against partial natural gas storage tank 302. Friction between storage region 300 and partial natural gas storage tank 302 causes their adjoining edges to heat and eventually weld together.

Figure 3B:
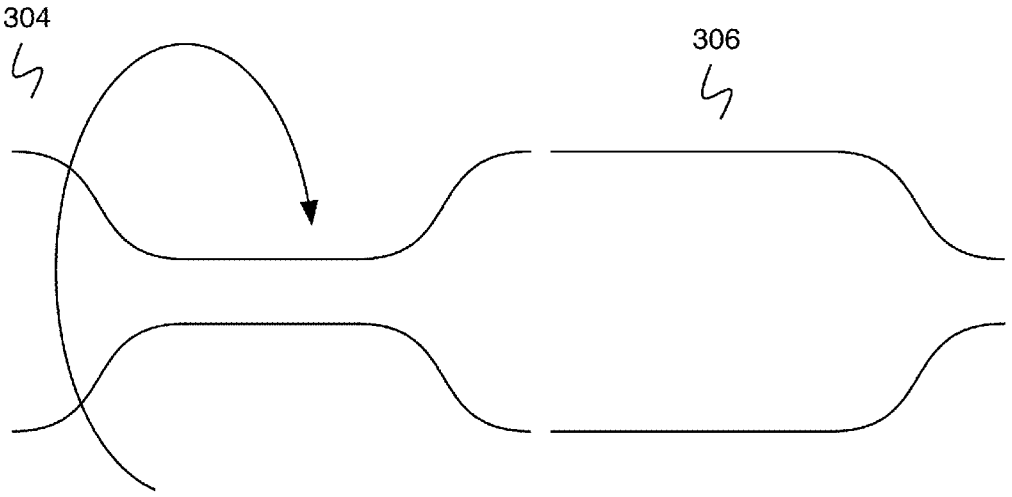
FIG. 3B is a diagram illustrating an embodiment of a joining process.

FIG. 3B is a diagram illustrating an embodiment of a joining process. In some embodiments, the joining process shown in FIG. 3B is used to form a natural gas storage tank (e.g., natural gas storage tank 120 of FIG. 1B). In the example shown, coupler 304 is to be joined to partial natural gas storage tank 306. Partial natural gas storage tank 306 comprises an alternating chain of storage regions and couplers, terminating with a storage region positioned adjacent to coupler 304. Coupler 304 is spun and forced against partial natural gas storage tank 306. Friction between coupler 304 and partial natural gas storage tank 306 causes their adjoining edges to heat and eventually weld together. In some embodiments, the joining processes of FIG. 3A and FIG. 3B alternate to form a chain of couplers and storage regions that can be folded into a desired volume (e.g., to form natural gas storage tank 100 of FIG. 1A).

Figure 4:
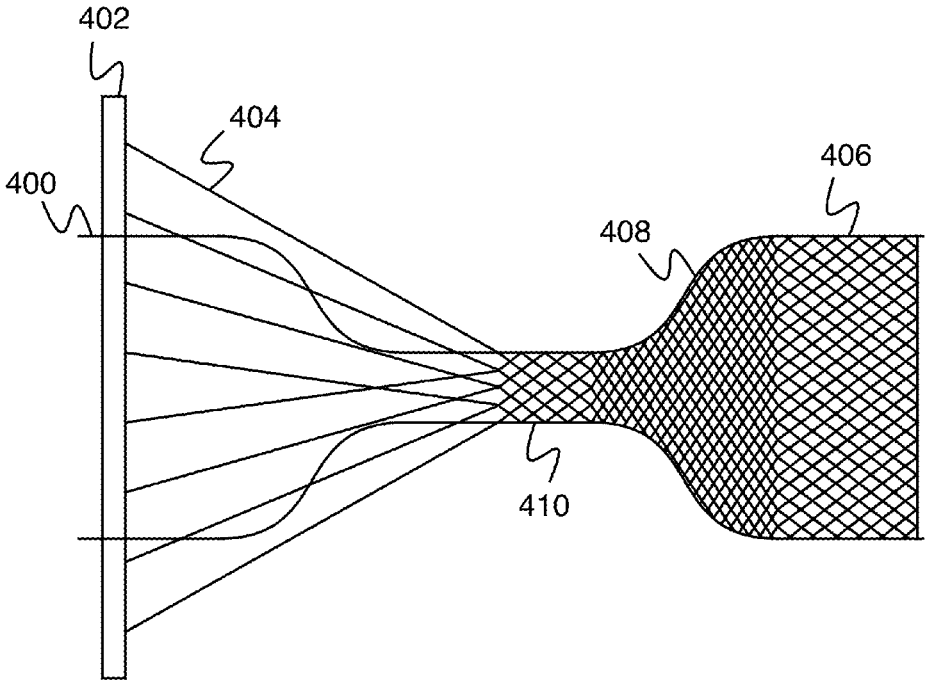
FIG. 4 is a diagram illustrating an embodiment of a braiding process.

FIG. 4 is a diagram illustrating an embodiment of a braiding process. In some embodiments, the braiding process shown in FIG. 4 is used to form a fiber layer surrounding a natural gas storage tank. In some embodiments, the fiber layer increases burst pressure. Natural gas storage tank 400 comprises a natural gas storage tank (e.g., natural gas storage tank 120 of FIG. 1B). In the example shown, natural gas storage tank 400 is not folded (e.g., the bending regions of natural gas storage tank 400 are not bent). Natural gas storage tank 400 passes through braiding machine 402 (e.g., traveling left to right). Braiding machine 402 braids fibers (e.g., fiber 404) around natural gas storage tank 400 as natural gas storage tank 400 moves. In some embodiments, fibers are braided around natural gas storage tank 400 using an optimum braid angle (e.g., a braid angle that provides the highest possible braid strength). In some embodiments, an optimum braid angle comprises a different braid angle over a region of changing width (e.g., over transition region 408) than over a region of consistent width (e.g., over storage region 406 or bending region 410). In various embodiments, an optimum braid angle over a region of changing width comprises a higher braid angle compared to an optimum braid angle over a region of consistent width, a lower braid angle compared to an optimum braid angle over a region of consistent width, a continuously changing braid angle, or any other appropriate braid angle. In various embodiments, the braid angle is changed by changing the process of braiding wheel 402, by changing the speed of natural gas storage tank passing through braiding wheel 402, or is changed in any other appropriate way. In some embodiments, a single layer braid is formed. In some embodiments, a multiple layer braid is formed. In some embodiments, a single layer braid is formed over wide regions (e.g., storage region 406) and a multiple layer braid is formed over narrow regions (e.g., bending region 410). In various embodiments, fiber 404 comprises carbon fibers, carbon fibers pre-impregnated with epoxy resin (pre-preg), glass fibers, plastic fibers, metal fibers, or any other appropriate fibers. In some embodiments, if the braid is constructed with pre-preg carbon the storage tank is additionally put into an oven to cure after it is folded into its final shape. In some embodiments, if the storage tank is braided with dry carbon, a resin process is used to impregnate the fibers before or after it is bent into its final shape.

In some embodiments, the optimum braid angle is the angle that maintains hose angle as the diameter changes. The hose angle here to be the fiber angle that equalizes hoop and axial stress. In some embodiments, with full control over the mandrel feed rate (v) and carrier angular velocity ($\omega$) it is possible to create a tapered braid that maintains stress equilibrium in the fibers over the taper. The hose angle for tapered braids is as follows—in a tapered thin walled pressure vessel with wall thickness t and positive pressure P, the hoop stress ($\sigma_h$) at any point along the z-axis is the same as a cylindrical pressure vessel with radius equal to the radius at that point:

$$\sigma_h = Pr/t$$

The axial stress ($\sigma_a$) is determined by the largest cross section of the cone. This is true because the axial reaction force must be equal to the largest force along the axis to achieve equilibrium. At the largest cross-section of the cone, (R), the axial stress is known to be twice that of the hoop stress (for a constant cross-section vessel of equal radius to the largest section this is true, thus by continuity it must be true at the cone/cylinder interface.) Thus the axial stress along the whole cone is:

$$\sigma_a = PR/(2t)$$

In a braided pressure vessel, it is desired that the axial force and hoop force to be in equilibrium. This is achieved by adjusting the braid angle ($\theta_b$) such that the portion of hoop force in the braid fibers is equal to the portion of axial force. Since the hoop force is a function of cone radius the braid angle is as well. In a traditional, cylindrical, pressure vessel this angle takes on a single value ($\arctan\sqrt{2}$) and is called the 'hose' angle (e.g., the braid angle of a braided fire hose). To find the 'hose' angle for a cone ($\theta_h$) a square cross-section is assumed for braid fibers with thickness t. The axial force is given by:

$$T\sin(\theta_h) = PR\tan(\theta_h)/(2t)$$

The hoop force is given by:

$$T\cos(\theta_h) = Pr/t$$

Solving for $\theta_h$ yields:

$$\theta_h = \arctan((2r/R)^{0.5})$$

This is the optimal braid angle as a function of mandrel radius for variable radius braids with largest radius R. Braiders can use this equation to dynamically set machine parameters and keep that braid angle ideal throughout the braiding process.

The cover fraction (cf) is the fraction of the surface area of a composite braid that is covered by fiber. In pressure vessels, having a cover factor that is too small will result in excessive radial shear stresses acting on the diamond shaped interstices in between the fibers of a biaxial weave. Those interstices are triangular in a tri-axial weave. When the shear forces exceed the shear strength of the matrix, the structure fails as the interstices 'blow out.' A braid is constructed so as to maintain optimum braid angle but also not allow blow out. In this subsection, we define geometric function of the minimum acceptable cover factor assuming ideal braid angle and isotropic matrix. The blow-out force on a unit diamond (the space defined by the area between the middle of the yarn for four interlacing fibers) is equal to the area in between the fibers which is defined as:

$$A = \frac{2}{\tan\alpha}\left(\frac{2\pi R}{n} - \frac{w}{2\cos\alpha}\right)$$

Where A is the area between the fibers, α is the braid angle, R is the radius of the tube, n is the number of carriers, and w is the width of the carriers. This force is applied in shear across the diamond. Due to scaling laws (surface area vs. edge length), the largest shear stress will be experienced at the boundary of the interstitial diamond. The perimeter of the area is defined by the fiber geometry as:

$$l = \frac{4}{\cos\alpha}\left(\frac{2\pi R}{n}\frac{w}{2\cos\alpha}\right)$$

Since stress is the ratio between force and area:

$$\tau_{yield} > \frac{\text{force}}{\text{area}} = \frac{PA}{lt}$$

$$\tau_{yield} > \frac{P\cos\alpha^2}{2t\text{sinalpha}}\left(\frac{2\pi R}{n} - \frac{w}{2\cos\alpha}\right)$$

Where P is the pressure inside the vessel, and t is the thickness of the epoxy. Assuming that the thickness of the epoxy is approximately equal to the width of the fiber:

$$\tau_{yield} > \frac{P\cos\alpha^2}{2\text{sinalpha}}\left(\frac{2\pi R}{wn} - \frac{1}{2\cos\alpha}\right)$$

Including the Geometric Definition of Coverage Factor:

$$c_f = 1 - \left(1 - \frac{wn}{4\pi R\cos\alpha}\right)$$

and using the equation for the optimal winding angle for the section of a cylindrical pressure vessel that is at a constricted radius relative to the widest section of tube:

$$\alpha = \arctan\sqrt{2\frac{R}{R_o}}$$

where Ro is the maximum radius of the pressure vessel. The above can be combined to yield a function of a minimum acceptable cover factor at a given radius reduction and the ideal braid angle:

$$c_f > 1 - \left(1 - \frac{P}{4\tau_{yield}\sqrt{2\frac{R}{Ro}} + 1/2}\right)^2$$

As long as the above inequality is followed, within a factor of safety for $\tau_{yield}$, the material will not fail by having a blowout. In order to find the actual cover factor for our tapered braid we can use the calculations below. We assume that the number of carriers (n) and the yarn width (w) are constant over the braid. At the largest radius (Ro) the cover factor is Co and the braid angle is θo. It is convenient to define two constants:

$$A = \frac{C_o}{1 - \left(1 - \frac{B}{R_o\cos\theta_o}\right)^2}$$

where $$B = \frac{nw}{4\pi}$$

The cover factor is then:

$$C_f = A\left(1 - \left(1 - \frac{B}{r\cos\theta}\right)\right)$$

If we wish to braid the taper using our 'hose' angle, $\theta_h$, we use the identity to obtain the cover factor as we braid an ideal taper:

$$C_f = A\left(1 - \left(1 - \frac{B}{r}\sqrt{1 + \frac{2r}{R_o}}\right)\right)$$

Once values are chosen for the nominal radius and the reduced radius (as well as values for the number of carriers and yard width), the cover factor can be checked over the reduction to see that it never goes below the inequality threshold.

Figure 5:
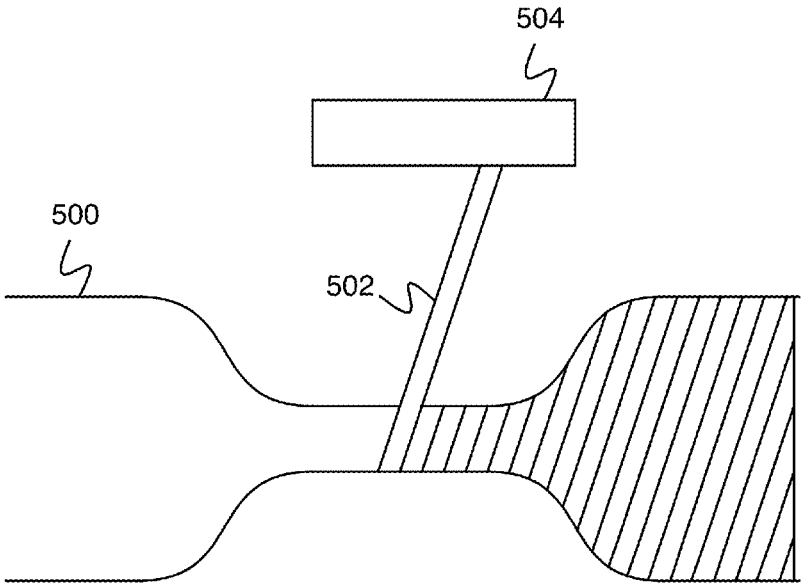
FIG. 5 is a diagram illustrating an embodiment of a fiber taping process.

FIG. 5 is a diagram illustrating an embodiment of a fiber taping process. In some embodiments, the fiber taping process shown in FIG. 5 is used to form a fiber layer surrounding a natural gas storage tank. Natural gas storage tank 500 comprises a natural gas storage tank (e.g., natural gas storage tank 120 of FIG. 1B). In the example shown, natural gas storage tank 500 is not folded (e.g., the bending regions of natural gas storage tank 500 are not bent). Natural gas storage tank 500 passes past tape supply 504 while rotating and is wrapped with fiber tape 502 to form a fiber layer. In some embodiments, natural gas storage tank 500 (e.g., a plurality of first vessel regions and a plurality of couplers) comprises a vessel form that is removed after the fiber layer is formed (e.g., the fiber layer holds its shape without natural gas storage tank 500). In some embodiments, the fiber layer comprises a material with low permeability to natural gas. In various embodiments, the fiber layer is whipped (e.g., formed by a whipping process), wound, braided, woven, taped, or formed by any other appropriate process.

Figure 6A:
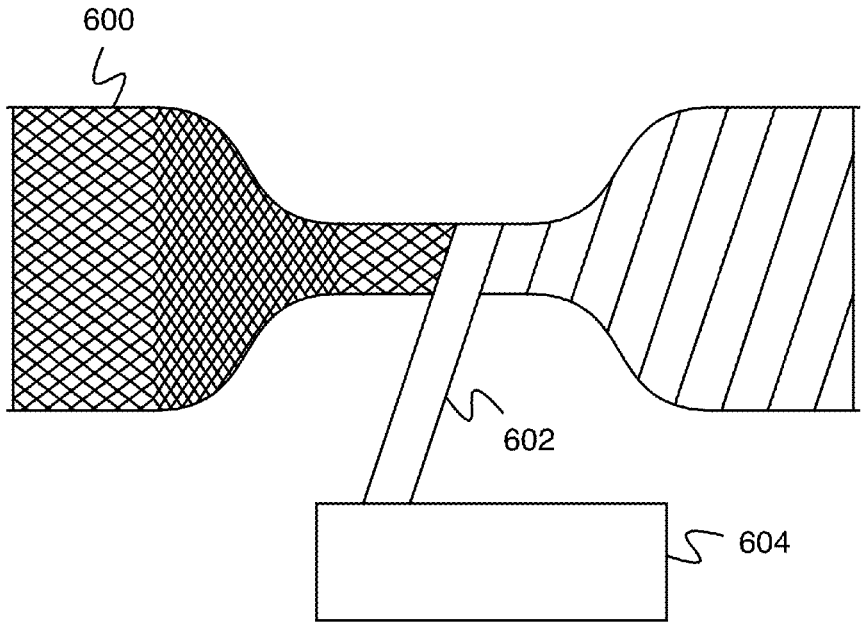
FIG. 6A is a diagram illustrating an embodiment of an abrasion prevention layer taping process.

FIG. 6A is a diagram illustrating an embodiment of an abrasion prevention layer taping process. In some embodiments, the abrasion prevention layer taping process shown in FIG. 6A is used to form an abrasion prevention surrounding a natural gas storage tank with a fiber layer. In the example shown, braided natural gas storage tank 600 comprises a natural gas storage tank with a braided fiber layer (e.g., a braided fiber layer formed as shown in FIG. 4). Braided natural gas storage tank 600 passes past tape supply 604 while rotating and is wrapped with abrasion prevention tape 602 to form an abrasion prevention layer.

Figure 6B:
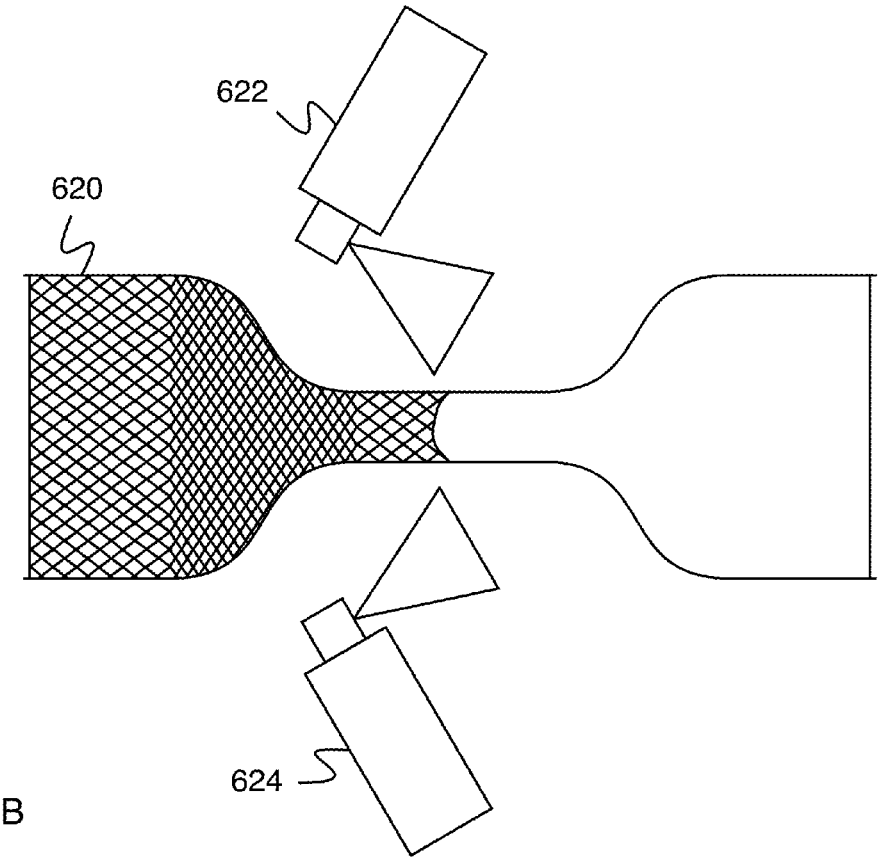
FIG. 6B is a diagram illustrating an embodiment of an abrasion prevention layer spray process.

FIG. 6B is a diagram illustrating an embodiment of an abrasion prevention layer spray process. In some embodiments, the abrasion prevention layer spray process shown in FIG. 6B is used to form an abrasion prevention surrounding a natural gas storage tank with a fiber layer. In the example shown, braided natural gas storage tank 620 comprises a natural gas storage tank with a braided fiber layer (e.g., a braided fiber layer formed as shown in FIG. 4). Braided natural gas storage tank 620 passes past spray abrasion prevention layer supply 622 and spray abrasion prevention layer supply 624 and received spray-on abrasion prevention material to form an abrasion prevention layer. In some embodiments, braided natural gas storage tank 620 rotates in order to improve abrasion prevention layer uniformity. In various embodiments, there are 1, 2, 4, 6, 11, or any other appropriate number of spray abrasion prevention layer supplies.

In various embodiments, the abrasion prevention layer comprises a spray on abrasion prevention layer, a taped abrasion prevention layer, a mold on abrasion prevention layer, a thermo polymer, or any other appropriate abrasion prevention layer.

Figure 7:
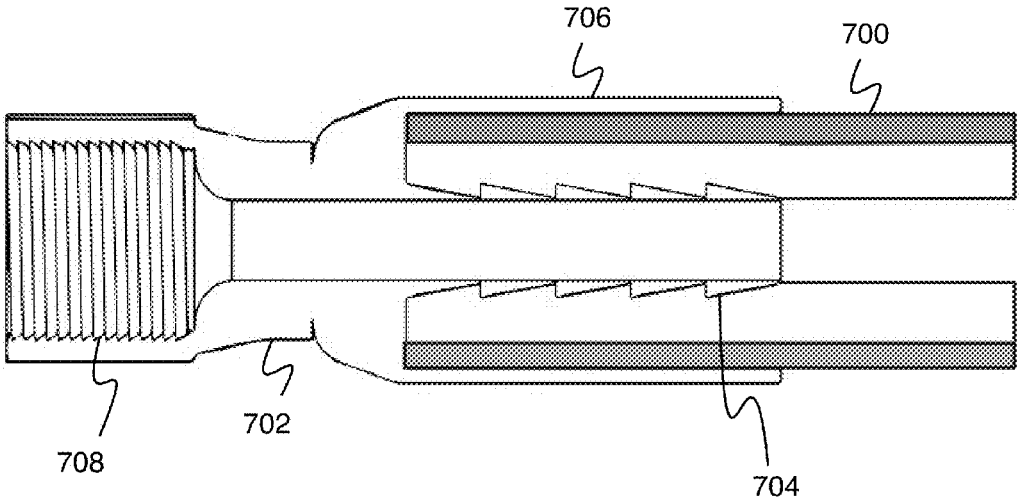
FIG. 7 is a diagram illustrating an embodiment of a fitting.

FIG. 7 is a diagram illustrating an embodiment of a fitting. In some embodiments, a fitting as in crimped fitting 702 is attached to one or both ends of a natural gas storage tank (e.g., one or both ends of natural gas storage tank 100 of FIG. 1A). In the example shown, tube 700 comprises a tube. In some embodiments, tube 700 comprises the end of a natural gas storage tank. Crimped fitting 702 comprises barbed tube 704 inserted into the end of tube 700 and crimper 706 surrounding the end of tube 700. Barbs of barbed tube 704 comprise ridges for preventing barbed tube 704 from exiting the end of tube 700. Crimper 706 comprises a stiff sheath for exerting inward force on the end of tube 700 and forcing it into the barbs of barbed tube 704, increasing the force necessary to remove crimped fitting 702 from tube 700. Crimped fitting 702 additionally comprises internal threads 708 for attaching further natural gas storage or transportation equipment.

Figure 8:
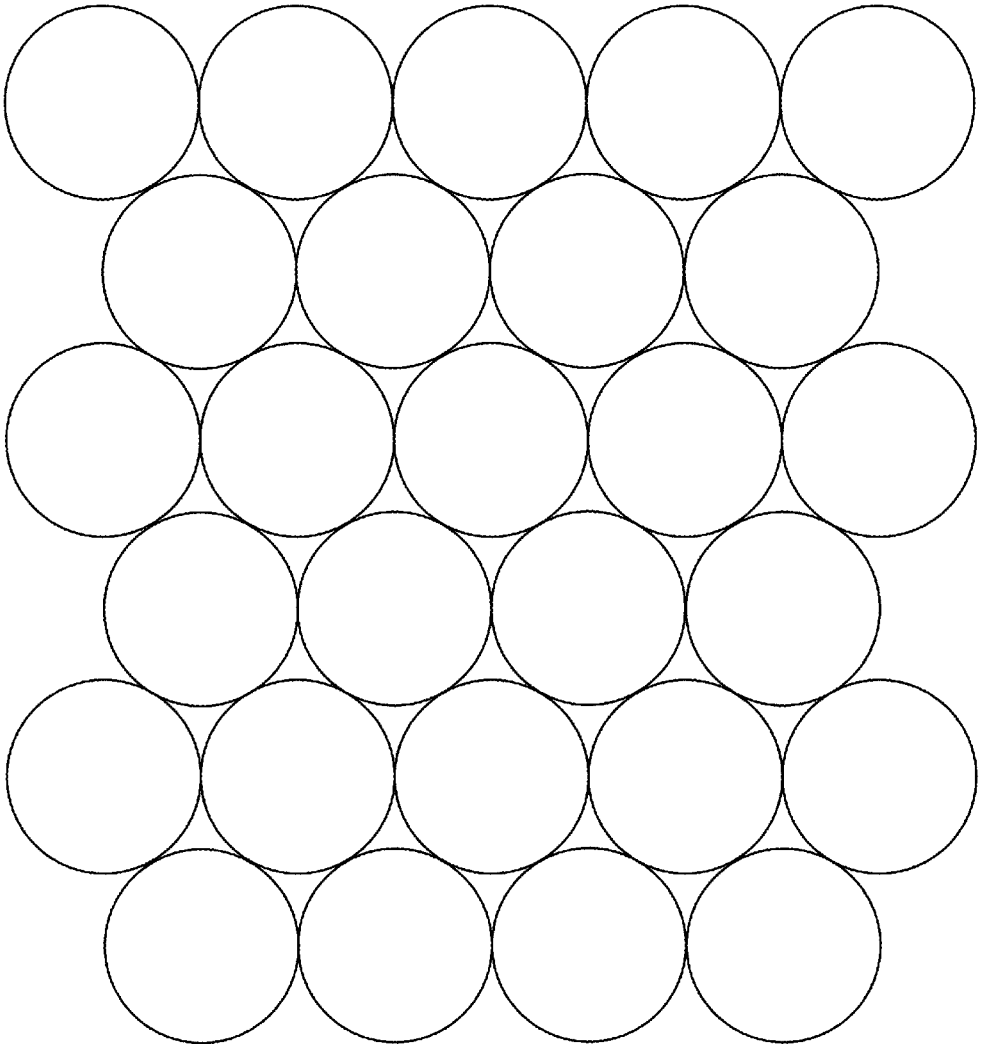
FIG. 8 is a diagram illustrating an embodiment of a hexagonal dense packing.

FIG. 8 is a diagram illustrating an embodiment of a hexagonal dense packing A hexagonal dense packing comprises the densest possible packing of a set of circles of equal size. In some embodiments, the hexagonal dense packing shown in FIG. 8 illustrates the cross section of a set of tubes comprising a natural gas storage tank. In some embodiments, the hexagonal dense packing shown in FIG. 8 illustrates the cross section of a set of tubes comprising a natural gas storage tank in a plane perpendicular to the set of storage regions.

Figure 9:
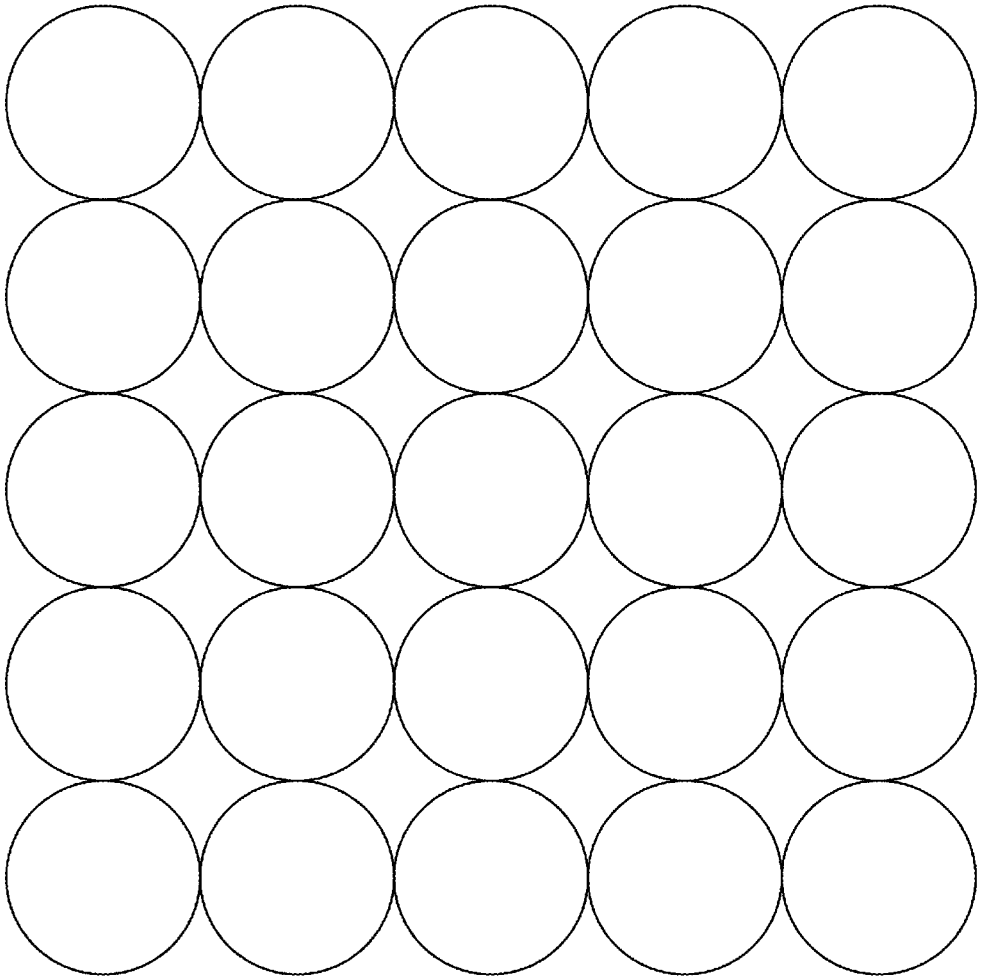
FIG. 9 is a diagram illustrating an embodiment of a rectangular packing.

FIG. 9 is a diagram illustrating an embodiment of a rectangular packing. In some embodiments, the rectangular packing shown in FIG. 9 illustrates the cross section of a set of tubes comprising a natural gas storage tank. In some embodiments, the rectangular packing shown in FIG. 9 illustrates the cross section of a set of tubes comprising a natural gas storage tank in a plane perpendicular to the set of storage regions.

Figure 10:
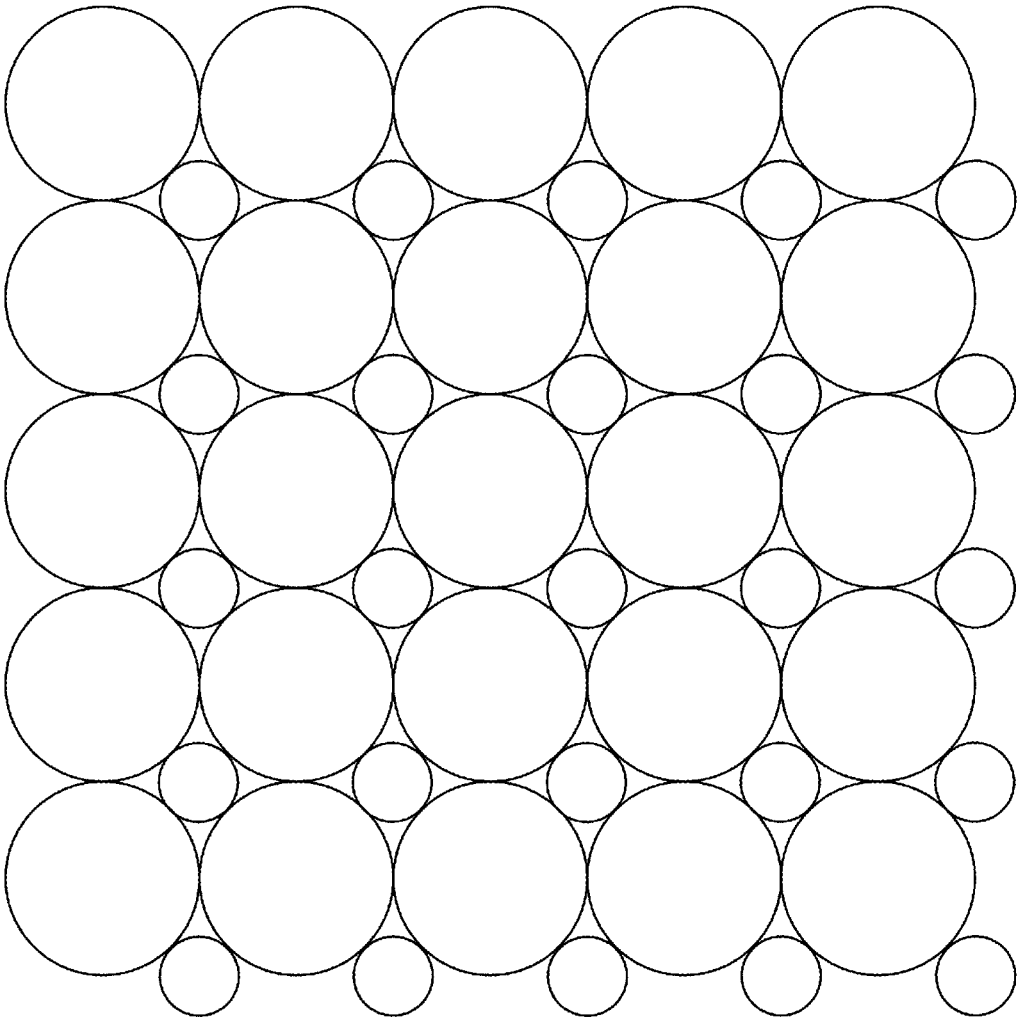
FIG. 10 is a diagram illustrating an embodiment of a c4 packing.

FIG. 10 is a diagram illustrating an embodiment of a c4 packing A c4 packing comprises a possible dense packing of a set of circles of two different radii. In some embodiments, the rectangular packing shown in FIG. 10 illustrates the cross section of a set of tubes comprising a natural gas storage tank. In some embodiments, the rectangular packing shown in FIG. 9 illustrates the cross section of a set of tubes comprising a natural gas storage tank in a plane perpendicular to the set of storage regions and bending regions (e.g., the bending regions are bent twice and extend parallel to the storage regions in between bends). In some embodiments, the larger circles comprise storage regions tubes and the smaller circles comprise tubes the same radius as the bending regions. In some embodiments, the radius ratio of the smaller tubes to the larger tubes is 0.4142135624.

Figure 11A:
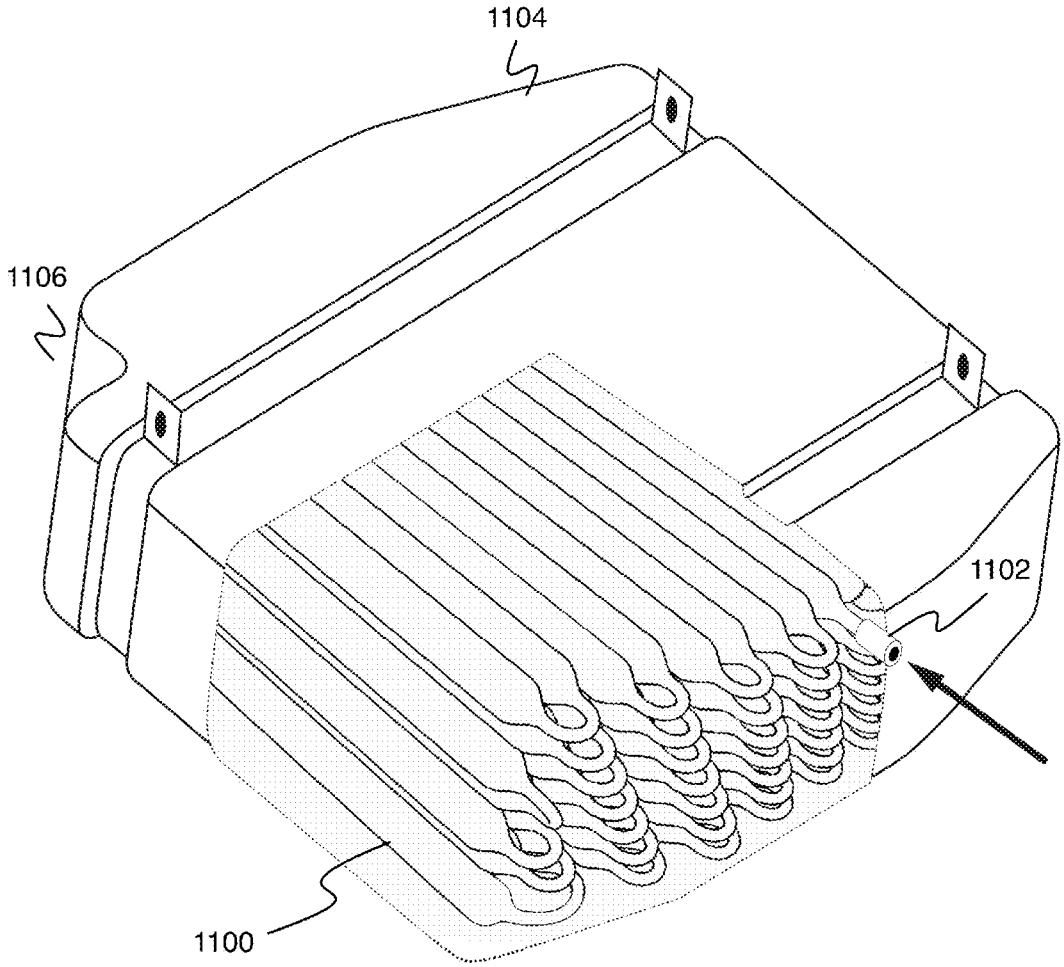
FIG. 11A is a diagram illustrating an embodiment of a natural gas storage tank mounted in a mounting box.

FIG. 11A is a diagram illustrating an embodiment of a natural gas storage tank mounted in a mounting box. In some embodiments, natural gas storage tank 1100 comprises a natural gas storage tank (e.g., natural gas storage tank 100 of FIG. 1A). In the example shown, natural gas storage tank 1100 is folded and mounted in mounting box 1104. Fitting 1102, mounted on an end of natural gas storage tank 1100, extends through hole 1106 in mounting box 1104, providing an external connection to natural gas storage tank 1100. In various embodiments, the external connection to natural gas storage tank 1100 is for filling natural gas storage tank 1100, for drawing gas from natural gas storage tank 1100, for venting natural gas storage tank 1100 in case of emergency, or for any other appropriate purpose. In some embodiments, there is more than one external connection to natural gas storage tank 1100. In various embodiments, an external connection to natural gas storage tank 1100 is at a corner of mounting box 1104, at an arbitrary point on an edge of mounting box 1104, at an arbitrary point on a face of mounting box 1104, or at any other appropriate location. In the example shown, notch 1106 (e.g., the notch in the shape of mounting box 1104) is necessary for mounting mounting box 1104 in its desired location.

Figure 11B:
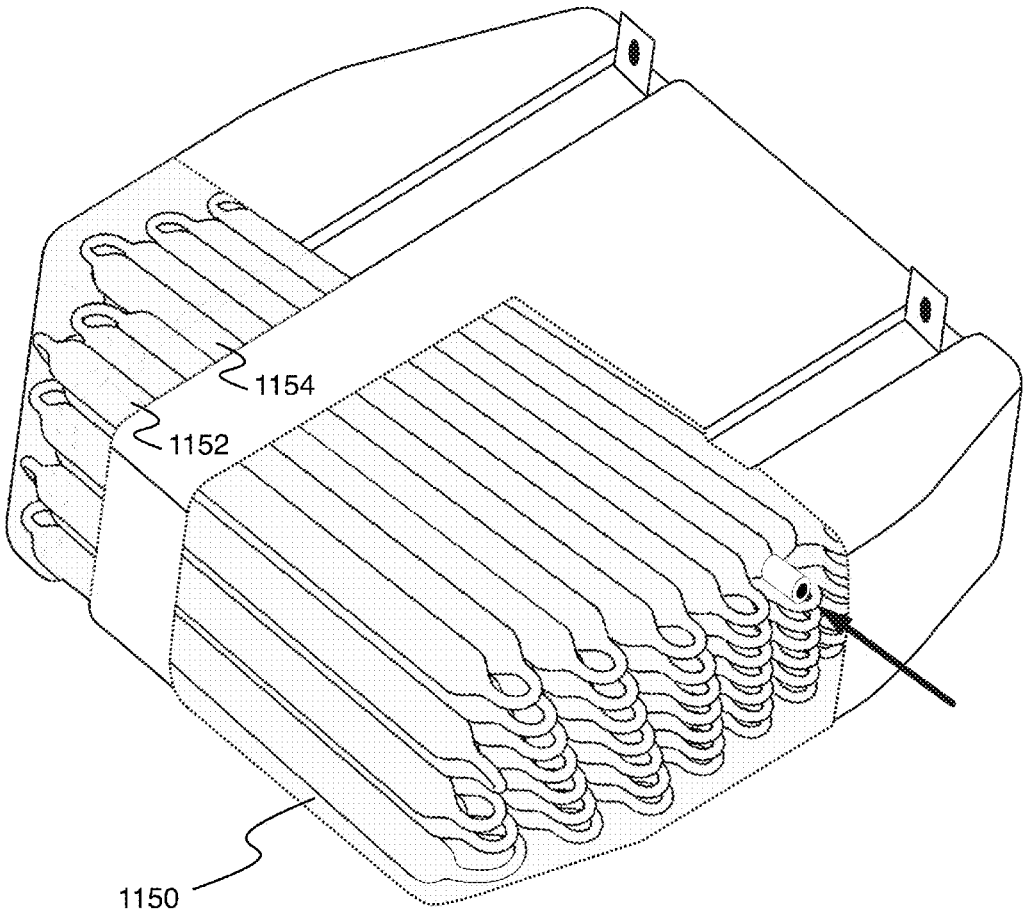
FIG. 11B is a diagram illustrating an embodiment of a natural gas storage tank mounted in a mounting box.

FIG. 11B is a diagram illustrating an embodiment of a natural gas storage tank mounted in a mounting box. In some embodiments, natural gas storage tank 1150 comprises natural gas storage tank 1100 of FIG. 11A. In the example shown, storage region 1152 and storage region 1154 are visible in the area at the portion of natural gas storage tank 1150 at the left corner of the image (e.g., in the region corresponding to notch 1106 of FIG. 11A). In the example shown, storage region 1152 and storage region 1154 are of different lengths.

Figure 12:
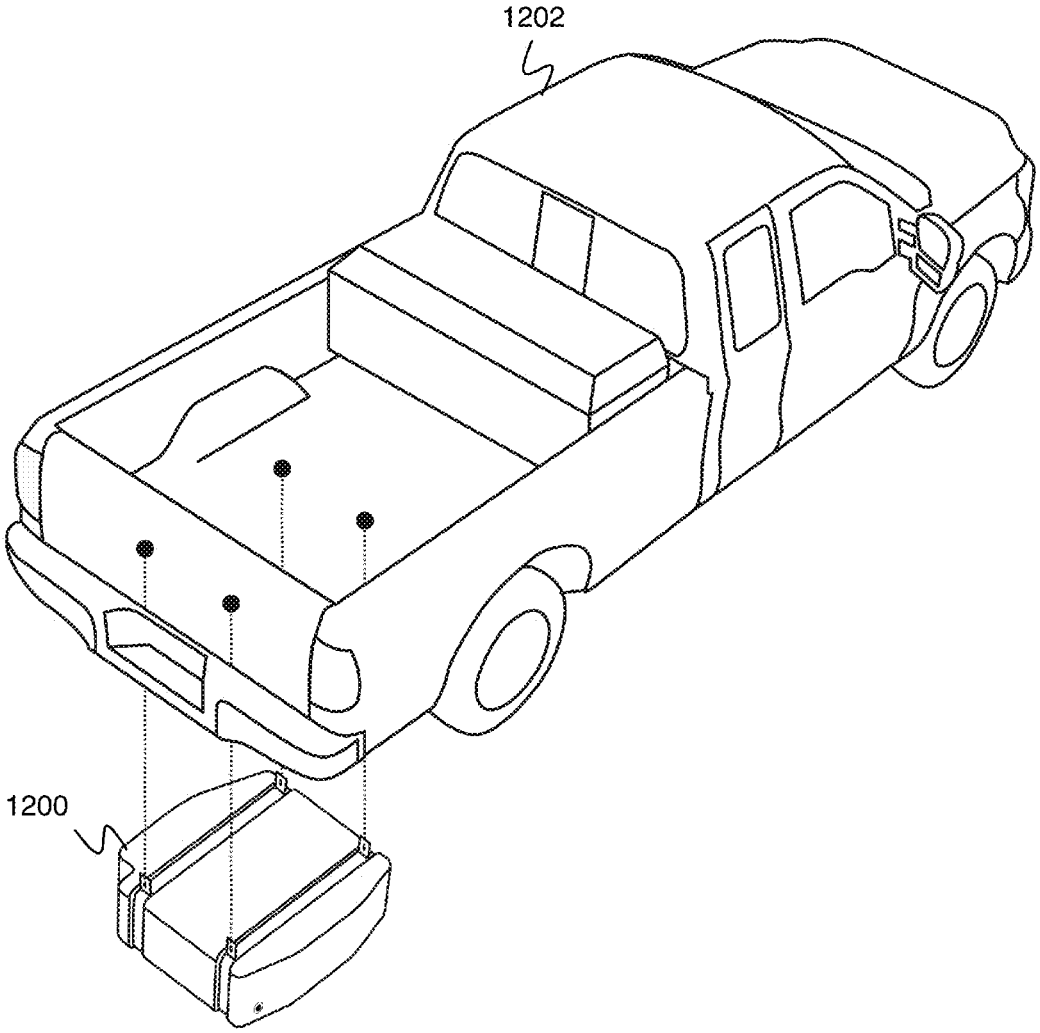
FIG. 12 is a diagram illustrating an embodiment of a natural gas storage tank mounted in a mounting box on a truck.

FIG. 12 is a diagram illustrating an embodiment of a natural gas storage tank mounted in a mounting box on a truck. In some embodiments, natural gas storage tank 1200 comprises a natural gas storage tank (e.g., natural gas storage tank 100 of FIG. 1A) mounted in mounting box 1202 (e.g., mounting box 1104 of FIG. 11A). In the example shown, mounting box 1202 is mounted on truck 1204. Mounting box 1202 is mounted in a cavity intended for a spare tire for truck 1204. In various embodiments, mounting box 1202 is mounted in a cavity intended for a gas tank for truck 1204, in the bed of truck 1204, or at any other appropriate location on truck 1204. Natural gas storage tank 1200 and mounting box 1202 can be designed to efficiently fill any appropriate cavity in truck 1204 in order to store as much natural gas as possible.

Figure 13:
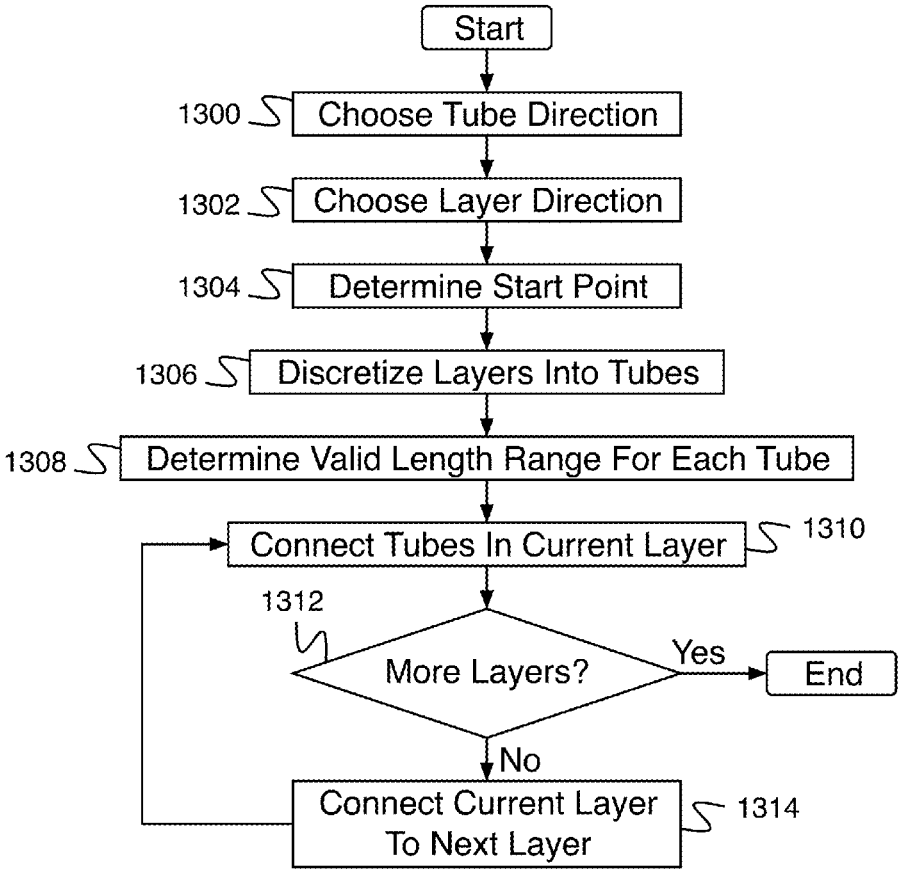
FIG. 13 is a flow diagram illustrating an embodiment of a process for designing a natural gas storage tank.

FIG. 13 is a flow diagram illustrating an embodiment of a process for designing a natural gas storage tank. In some embodiments, the process of FIG. 13 is used to determine the lengths of storage regions (e.g., storage region 102 of FIG. 1A) and bending regions (e.g., bending regions 104 of FIG. 1A) of a natural gas storage tank (e.g., natural gas storage tank 100 of FIG. 1A). In the example shown, in 1300, the tube direction is chosen. For example, the box dimensions are considered and a direction for the larger diameter storage tubes is selected. In some embodiments, a box dimension that is the longest is selected for the large radius tube direction. In some embodiments, the tube direction comprises the direction parallel to the storage regions of the tubes. In 1302, the layer direction is chosen. In some embodiments, the layer direction comprises a direction perpendicular to the tube direction and parallel to each layer of tubes. In 1304, a start point is determined. In some embodiments, a start point comprises a tube end. In some embodiments, a start point comprises a fitting location (e.g., a location for making a connection to the natural gas storage tank). In 1306, layers are discretized into tubes. In some embodiments, discretizing layers into tubes comprises determining the number and location of each tube in each layer. In some embodiments, discretizing layers into tubes comprises selecting a packing type (e.g., hexagonal, rectangular, c4, etc.). In some embodiments, discretizing layers into tubes comprises aligning a tube of the selected packing cross-section with the fitting location. In 1308, a valid length range for each tube is determined. For example, within the layer the extent of a tube is determined to fit within the box and still allow for coupling using the bends at each end of the tube and the space required for the connections. In some embodiments, determining a valid length range for each tube comprises determining the maximum allowable length for the tube and the coupler such that they remain within the storage volume. 1310, tubes in the current layer are connected together. In some embodiments, the current layer is the first layer (e.g., the layer including the start point). In various embodiments, connecting the tubes comprises determining the length of each tube (e.g., each storage region) in the layer, determining the locations of bending regions, determining the length of bending regions, determining the number of tubes in the layer, or determining any other appropriate layer parameter. In some embodiments, one or more tubes that are at the end of a layer are left out because including them would cause the next layer to be unreachable. In 1312, it is determined if there are more layers. If it is determined in 1312 that there are more layers, control passes to 1314. If it is determined in 1312 that there are not more layers, the process ends.

Figure 14:
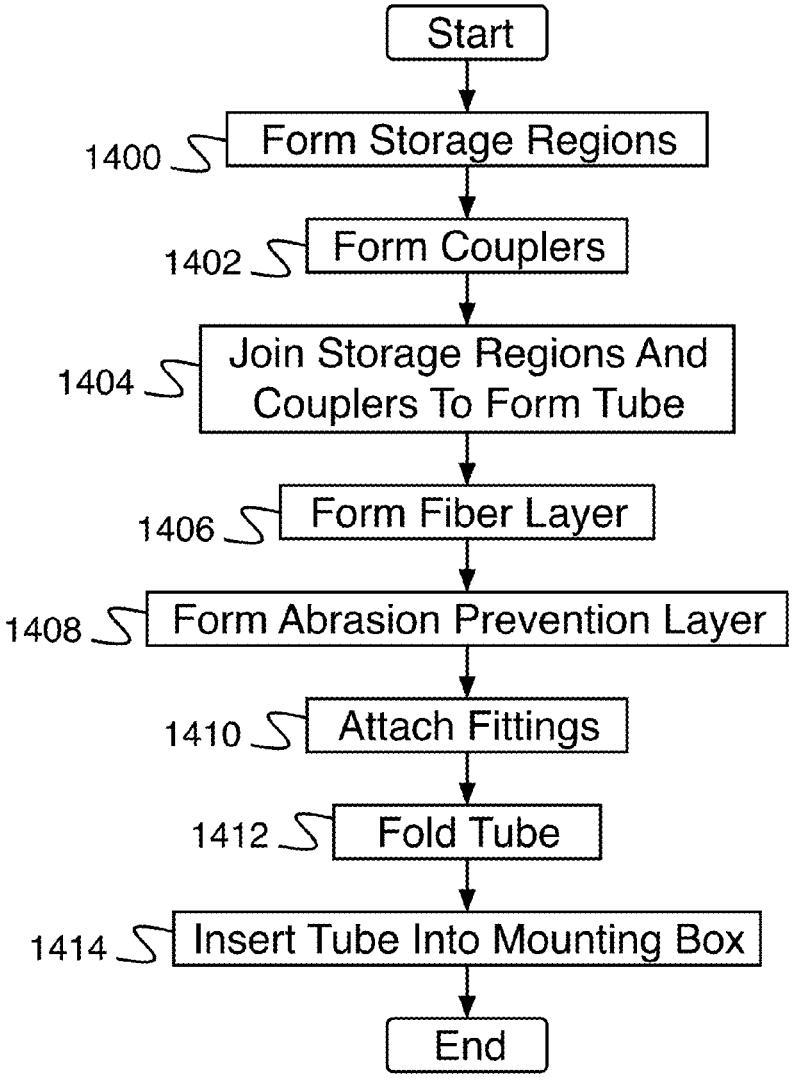
FIG. 14 is a flow diagram illustrating an embodiment of a process for manufacturing a natural gas storage tank.

FIG. 14 is a flow diagram illustrating an embodiment of a process for manufacturing a natural gas storage tank. In some embodiments, the process of FIG. 14 is used for manufacturing natural gas storage tank 100 of FIG. 1A. In the example shown, in 1400, storage regions are formed. In some embodiments, storage regions are formed by extrusion and cut to appropriate lengths (e.g., appropriate lengths as determined using the design process of FIG. 13). In 1402, couplers are formed. In some embodiments, couplers are formed by injection molding. In some embodiments, couplers including bending regions of one or more lengths are formed by injection molding into one or more different molds. In 1404 storage regions and couplers are joined to form a tube. In some embodiments, storage regions and couplers are joined by spin welding. In 1406, a fiber layer is formed. In some embodiments, a fiber layer is braided. In 1408, an abrasion prevention layer is formed. In some embodiments, an abrasion prevention layer is sprayed on. In 1410 fittings are attached. In some embodiments, crimped fittings are attached. In 1412, the tube is folded. In 1414, the tube is inserted into a mounting box.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A high-pressure pressure vessel for storing natural gas, comprising:

a plurality of elongated cylindrical first vessel regions of first diameters, each first vessel region defined by an elongated cylindrical wall, wherein a three dimensional volume is filled using at least in part the plurality of first vessel regions, wherein the plurality of first vessel regions are disposed in a plurality of layers with each layer comprising two or more vessel regions having a different length, and wherein each of the plurality of first vessel regions are disposed in parallel to each other along different respective axes and each extending between a first and second terminal end along the different respective axes;

a plurality of couplers disposed at one of the first and second terminal ends, wherein each coupler of the plurality of couplers couples each pair of first vessel regions of the plurality of first vessel regions without couplers being disposed between the first and second terminal ends;

wherein each coupler of the plurality of couplers comprises a second vessel region of a second diameter and two third vessel regions that transition diameters between the first diameter and the second diameter;

wherein the three dimensional volume is filled using at least in part the plurality of couplers;

wherein the first vessel regions and the couplers comprise a material with low permeability to natural gas; and a fiber layer, wherein the fiber layer surrounds the plurality of first vessel regions and the plurality of couplers.

2. A high-pressure pressure vessel as in claim 1, wherein one of the two vessel regions has a taper between the first diameter and the second diameter based at least in part on a mean curvature of the taper.

3. A high-pressure pressure vessel as in claim 1, wherein the second diameter is smaller than the first diameter.

4. A high-pressure pressure vessel as in claim 1, wherein a third vessel region is coupled to an end of the second vessel region.

5. A high-pressure pressure vessel as in claim 1, wherein the material with low permeability to natural gas comprises ethylene vinyl alcohol.

6. A high-pressure pressure vessel as in claim 1, wherein the second vessel region is bent.

7. A high-pressure pressure vessel as in claim 1, wherein filling the three dimensional volume comprises a cross sectional dense packing.

8. A high-pressure pressure vessel as in claim 7, wherein the cross sectional dense packing comprises at least one of a hexagonal packing, a rectangular packing and a c4 packing.

9. A high-pressure pressure vessel as in claim 1, wherein the fiber layer increases the burst pressure.

10. A high-pressure pressure vessel as in claim 1, wherein the plurality of first vessel regions and the plurality of couplers comprises a vessel form that is removed after the fiber layer is formed such that the fiber layer holds its shape without the removed vessel form.

11. A high-pressure pressure vessel as in claim 1, wherein the fiber layer is whipped, wound, braided, or woven.

12. A high-pressure pressure vessel as in claim 1, wherein the fiber layer comprises carbon fibers.

13. A high-pressure pressure vessel as in claim 1, wherein the fiber layer is braided using an optimum braid angle based at least in part on one or more radius of the pressure vessel.

14. A high-pressure pressure vessel as in claim 1, wherein the fiber layer is braided using a different optimum braid angle for each region based at least in part on a different taper geometry of each region.

15. A high-pressure pressure vessel as in claim 1, further comprising a plurality of stacked braided layers surrounding the plurality of first vessel regions and the plurality of couplers.

16. A high-pressure pressure vessel as in claim 1, further comprising an abrasion prevention layer defined by rectangular tape wrapped over the fiber layer.

17. A method, comprising:

providing a plurality of elongated cylindrical first vessel regions of first diameters, each first vessel region defined by an elongated cylindrical wall, wherein an irregularly shaped three dimensional volume is density filled using at least in part the plurality of first vessel regions disposed parallel to each other and extending in a stacked parallel configuration, wherein each of the plurality of first vessel regions are disposed in parallel to each other along different respective axes and each extending between a first and second terminal end along the different respective axes;

providing a plurality of couplers, wherein each coupler of the plurality of couplers couples each pair of first vessel regions of the plurality of first vessel regions at one of the first and second terminal ends and without couplers between the first and second terminal ends;

wherein each coupler of the plurality of couplers comprises a second vessel region of a second diameter and two third vessel regions that transition diameters between the first diameter and the second diameter; and wherein the three dimensional volume is filled using at least in part the plurality of couplers; and wherein the first vessel regions and the couplers comprise a material with low permeability to natural gas; and providing a fiber layer, wherein the fiber layer surrounds the plurality of first vessel regions and the plurality of couplers.

18. A high-pressure pressure vessel for storing natural gas, comprising:

a mounting box defining an irregularly shaped volume and having a first and second end;

a plurality of first vessel regions of first diameters, each first vessel region defined by an elongated cylindrical wall, wherein a three dimensional volume is filled using at least in part the plurality of first vessel regions in a stacked and parallel configuration, wherein each of the plurality of first vessel regions are disposed in parallel to each other along different respective axes and each extending between a first and second terminal end along the different respective axes; and a plurality of couplers, wherein each coupler of the plurality of couplers couples each pair of first vessel regions of the plurality of first vessel regions at one of the first and second terminal ends without couplers between the first and second terminal ends;

wherein each coupler of the plurality of couplers comprises a second vessel region of a second diameter and two third vessel regions that transition diameters between the first diameter and the second diameter;

wherein the three dimensional volume is filled using at least in part the plurality of couplers;

wherein the coupled first vessel regions and couplers are folded into a unitary structure having the first vessel regions grouped together to define a plurality of layered rows, with each row comprising two or more first vessel regions of different lengths, the unitary structure filling the irregularly shaped volume at high density; and wherein the first vessel regions and the couplers comprise a material with low permeability to natural gas.

19. A high-pressure pressure vessel as in claim 18 wherein the mounting box is disposed within a body of the motor vehicle and coupled to the chassis of the motor vehicle.

* * * * *